United States Patent [19]

Saeki et al.

[11] Patent Number: 4,876,869

[45] Date of Patent: Oct. 31, 1989

[54] INNER GROOVING PROCESS FOR A METALLIC TUBE

[75] Inventors: Chikara Saeki, Hatano; Minoru Nishibe, Kobe, both of Japan

[73] Assignee: Kabushiki Kaisha Kobe Seiko Sho, Kobe, Japan

[21] Appl. No.: 214,054

[22] Filed: Jun. 30, 1988

[30] Foreign Application Priority Data

Jul. 7, 1987 [JP] Japan ..... 62-169571

[51] Int. Cl.[4] ..... B21C 3/08; B21C 37/06; B21D 53/06; B21D 17/04

[52] U.S. Cl. ..... 72/68; 72/78; 72/283

[58] Field of Search ..... 72/68, 70, 71, 77, 78, 72/276, 278, 282, 283; 29/157.3 A, 157.3 A H, 157.3 C

[56] References Cited

U.S. PATENT DOCUMENTS 4,712,407 12/1987 Yoshika et al. ..... 72/68

FOREIGN PATENT DOCUMENTS 37059 3/1979 Japan .
103215 8/1980 Japan .
112929 7/1982 Japan ..... 72/78
28418 7/1984 Japan ..... 72/68
3916 1/1985 Japan ..... 72/283
209723 9/1986 Japan ..... 72/68
266121 11/1986 Japan ..... 72/77

*Primary Examiner*—Lowell A. Larson
*Attorney, Agent, or Firm*—Oblon, Spivak, McClelland, Maier & Neustadt

[57] ABSTRACT

An inner grooving process for the tube expanding rolling type by which inner grooves such as wide width grooves or deep grooves which cannot normally be formed readily can be formed with a high quality using an equipment of a simple structure without deteriorating the operability. In the process, a drawing die having an exit hole of a fixed diameter and a floating plug having no bearing portion thereon are used. The floating plug and a grooved plug connected for rotation to the floating plug and having an outer diameter smaller than the diameter of the exit hole of the drawing die are inserted into a metallic tube and then the grooved plug is drawn to a location of the rolling member into the metallic tube by drawing and then retained at such location. The floating plug and the drawing die then cooperate with each other to reduce the inner diameter of the metallic tube to a dimension smaller than the outer diameter of the grooved plug and tube expanding rolling drawing is effected with a rolling member and the grooved plug thereby to expand and groove the metallic tube continuously.

3 Claims, 5 Drawing Sheets

INNER GROOVING PROCESS FOR A METALLIC TUBE

BACKGROUND OF THE INVENTION

1. Field of the Invention

This invention relates to production of an inner grooved metallic tube, and more particularly to an inner grooving process for a metallic tube which is suitable for a heat transfer tube of a heat exchanger for an air conditioner, a refrigerator or the like.

2. Description of the Prior Art

Various metallic tubes which have inner grooves of various shapes formed therein are desired as metallic tubes of copper, aluminum and similar materials which are used for heat transfer tubes of heat exchangers for an air conditioner, a refrigerator or the like.

Conventionally, as a process of producing such an inner grooved metallic tube, there is a rolling drawing process as one of so-called tube reducing type grooving processes wherein grooves are formed on an inner wall of a metallic tube to be worked while the metallic tube is being reduced in diameter as disclosed, for example, in Japanese Patent Laid-Open No. 54-37059 and Japanese Patent Laid-Open No. 55-103215.

According to the rolling drawing process, as illustrated in FIG. 3, while a metallic tube 21 is gripped at an end thereof and is drawn by a chuck, it is pressed from the outside by means of a hole die 22 and a floating plug 23 to reduce the diameter thereof, and then an inner wall of the metallic tube 21 is pressed against a grooved plug 25 mounted upstream in the tube 21 by means of rolling rollers or balls 24 disposed around an outer periphery of the metallic tube 21 in order to form grooves 26 on the inner wall of the tube 21.

According to the process, however, since the revolving rolling rollers or balls 24 are pressed against the metallic tube 21 at a location where the grooved plug 25 is located to reduce the inner and outer diameters of the metallic tube 21 to form grooves on the metallic tube 21, if the drawing speed of the metallic tube 21 is excessively high, some portions of the metallic tube 21 may not be contacted by the rolling rolls or balls 24 and pressed portions of the metallic tube 21 may be discontinuous from each other, causing grooves to be formed intermittenttly, or else a reactive contraction force may act upon a portion of the metallic tube 21 which has just passed the pressing location of the rolling rollers or balls 24 so that such a floating phenomenon as illustrated in FIG. 4 may appear to cause the metallic tube 21 to be distorted. In this manner, there is a high possibility that displacement in phase of groove pitch and various interferences including a fillet interference, a trochoid interference and an involute interference may appear in combination to cause internal defects in the metallic tube 21. Further, since the metallic tube 21 having an inner diameter greater than an outer diameter of the grooved plug 25 is reduced in diameter and rolled by the rolling rollers or balls 24 so as to force the metallic tube 21 into the grooves of the grooved plug 25 to groove the metallic tube 21, a high degree of deformation is applied to the metallic tube 21. Accordingly, there is a problem in that metal flows may not be uniform at grooves or ridges of the metallic tube 21 so that defects may be produced at the slopes or bottoms of the grooves. Accordingly, where such a metallic tube is employed as a heat transfer tube, there are problems of reduction in pressure resisting strength, reduction in vibration fatigue strength, generation of metal powder, occurrence of a slow leak of a refrigerant caused by occurrence of a defect in brazing and so on.

In order to resolve such disadvantages of the rolling drawing process of such a tube reducing type as described above, a so-called tube expanding rolling process has been proposed wherein an inner wall of a metallic tube is grooved while the metallic tube is being expanded as illustrated in FIG. 5 (Japanese Patent Laid-Open No. 61-266121). According to the tube expanding process, at first a metallic tube 21 is reduced in diameter by means of a drawing die 29 and a floating plug 23 in a similar manner as in the tube reducing type rolling drawing process described above, and then it is grooved while it is being expanded by means of a grooved plug 28 which has an outer diameter greater than the inner diameter of the metallic tube 21.

However, while the tube expanding type rolling process can eliminate the disadvantages of the tube reducing type rolling process described above, it has a problem in a method of inserting the grooved plug 28, having a greater outer diameter than the inner diameter of the metallic tube 21, into the metallic tube 21 in advance.

In particular, where such a hole die as employed in the tube reducing type rolling process is employed as the drawing die 29, it is impossible to insert the grooved plug into the metallic tube 21 because the diameter of the exit hole thereof is fixed. Accordingly, in order to insert the grooved plug into the metallic tube 21, it is necessary either to construct the drawing die 29 such that the inner diameter of the exit hole thereof may be changed mechanically to a size sufficient to allow the grooved plug 28 to be inserted into the exit hole thereof or to cut an end portion of the metallic tube 21 into two arcuate portions over a predetermined length so as to allow insertion into the end portion of the metallic tube 21 of the grooved plug 28 which is to be subsequently connected to the floating plug 23. Accordingly, in the case of the former, the equipment is complicated in structure, while in the case of the latter, operability is significantly deteriorated.

SUMMARY OF THE INVENTION

It is an object of the present invention to provide an inner grooving process of the tube expanding rolling type which eliminates the drawbacks of the conventional process described above and by which inner grooves which cannot normally be formed readily such as wide width grooves or deep grooves can be formed with a high degree of quality using equipment of simple structure without deteriorating the operability.

In order to attain the object, the present inventor has made various examinations in order to discover measures by which a grooved plug can be inserted with a further high operability based on the assumption that, upon diameter reducing operation by the drawing die and use of a floating plug in the tube expanding rolling process, the diameter of an exit hole of a drawing die is fixed to assure simplification of the equipment.

As a result of such examinations, it has been found that, while the diameter of an exit hole of a drawing die must necessarily be of a dimension sufficient to allow at least a grooved plug to be inserted into the exit hole, the inner diameter of a metallic tube reduced in diameter is restricted by the outer diameter of a bearing portion of a floating plug. Accordingly, if it is attempted to pass the grooved plug smoothly through the drawing die, the grooved plug used must have an outer diameter equal to or smaller than the inner diameter of the metallic tube, which does not allow for expansion of the metallic tube by means of the grooved plug. On the other hand, if the outer diameter of the grooved plug is greater than the inner diameter of a metallic tube, the grooved plug will bite into the inner wall of the metallic tube already at the exit of the drawing die, which makes passage to the grooved plug very difficult. Anyway, an expanding operation by means of the grooved plug is impossible.

Thus, taking not of the fact that such a phenomenon originates in restriction of the inner diameter of a metallic tube by a bearing portion of a floating plug, drawing, using a floating plug having no bearing portion thereon, by means of a drawing die having an outer diameter of a fixed diameter together with the floating plug was attempted. This proved that a drawing reducing phenomenon takes place wherein a metallic tube reduced in diameter by the drawing die is reduced such that the outer diameter thereof is smaller than the inner diameter of the exit of the drawing die while it is not reduced in wall thickness. Accordingly, if the drawing reducing phenomenon is utilized effectively, even if the grooved plug having an outer diameter smaller than the inner diameter of the exit of the drawing die is passed through the drawing die in an idle drawing condition, the reduced metallic tube can be expanded by the grooved plug. Besides, it is possible to readily form inner grooves of various depths and shapes and the scope of application can be expanded remarkably. With the facts thus found out, the present invention has resulted.

According to the present invention, an inner grooving process is utilized for a metallic tube of the type wherein a metallic tube is reduced in diameter by means of a drawing die and a floating plug and is then grooved on an inner wall thereof by means of a rolling member supported on a retaining ring and a grooved plug whereafter the diameter of the metallic tube is adjusted by means of a diameter adjusting die, characterized in that the drawing die has an exit hole of a fixed diameter while a plug having no bearing portion thereon is used as the floating plug, and the floating plug and the grooved plug connected for rotation to the floating plug and having an outer diameter smaller than the diameter of the exit hole of the drawing die are inserted in advance into a metallic tube and then the grooved plug is drawn to a location of the rolling member into the metallic tube by drawing and then retained at the location, whereafter the floating plug and the drawing die cooperate with each other to reduce the outer diameter of the metallic tube to a dimension smaller than the diameter of the exit hole of the drawing die, and tube expanding rolling drawing is effected with the rolling member and the grooved plug the outer diameter of which is greater than the inner diameter of the thus reduced metallic tube thereby to groove the metallic tube continuously.

With the inner grooving process for a metallic tube according to the present invention, inner grooving of a metallic tube is effected based on the tube expanding rolling drawing process. Accordingly, not only the disadvantages of the conventional tube reducing rolling drawing process described above can be eliminated completely but also the problems of the conventional tube expanding rolling drawing process described above can be resolved. In addition, the following excellent effects can be anticipated.

(1) Since it is not necessary to employ, as the first die, a die wherein the diameter of an exit hole thereof can be changed mechanically as in the conventional equipment described above and since it is not necessary to divide an end portion of a metal tube to be worked into two semi-circular sections, insertion into and setting to predetermined locations in the tube of the floating plug and the grooved plug are facilitated together with simplification of the equipment, and no deterioration in operability will be brought about.

(2) Since a tube is expanded by the grooved plug to preliminarily shape grooves on the tube, possible displacement in phase of groove pitch upon rolling can be prevented and appearance of defects arising from interferences or the like upon shaping of grooves can be eliminated while at the same time the rolling rate is reduced so that a non-uniform metal flow will not appear readily and appearance of internal defects of the tube can be minimized. As a result, formation of inner grooves such as wide width grooves or deep grooves which cannot be shaped readily by conventional methods can be made readily.

(3) Since a tube to be worked is reduced in diameter using the floating plug which has no bearing portion thereon, work hardening of the tube is low, and since the high degree of working is applied to the tube, productivity can be improved. In addition, formation of grooves such as wide width grooves or deep grooves which are difficult to form and formation of grooves on a material which has a low shaping property can be made readily.

(4) Since a uniform radial load is normally applied to the grooved plug as a tube is expanded by the grooved plug, little influence of play or an inclination by a clearance between the grooved plug and a rotary shaft therefor occurs, and accordingly occurrence of internal defects can be prevented.

(5) Since grooves are preliminarily shaped as a tube is expanded by the grooved plug, the degree of pressing of the rolling member is reduced, then the influence of the curvature of the rolling member is moderated so that the condition of an outer surface of the tube to be worked can be improved.

Since such effects as described above can be attained, it is possible to produce an inner grooved tube of high quality with deteriorating productivity. The inner grooved tube thus produced can sufficiently meet various requirements for metallic tubes of the type and will further expand a demand for such metallic tubes.

The above and other objects, features and advantages of the present invention will become apparent from the following description and the appended claims, taken in conjunction with the accompanying drawings.

DESCRIPTION OF THE PREFERRED EMBODIMENT

An inner grooving process according to the present invention is characterized and advantageous, compared with the conventional process of the tube expanding rolling type described above, in that drawing into and holding in a metallic tube of a grooved plug can be put into practice with a high degree of operability by equipment of simple construction.

Figure 1:
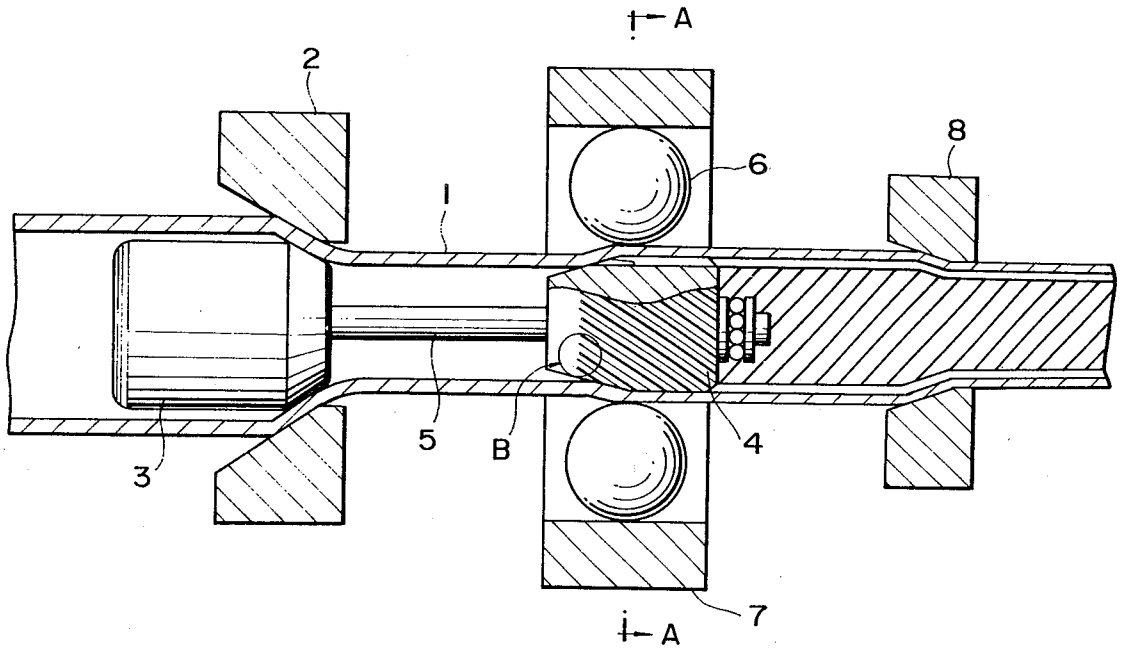
FIG. 1 is a schematic sectional view showing an example of equipment which is used to practice the inner grooving process for a metallic tube according to the present invention and the working condition of the equipment.

Referring first to FIG. 1, there are shown a working condition of the inner grooving process of the present invention and equipment used in the process. In FIG. 1, reference numeral 1 denotes an annealed metallic tube of copper or a copper alloy or the like to be worked, 2 a first die having an exit hole of a fixed diameter, 3 a floating plug having no bearing portion thereon, and 4 a grooved plug connected for rotation to the floating plug 3 by means of a tie rod 5 and a thrust bearing. Rolling members (rolling balls or rolls) 6 adapted to revolve while rotating are disposed on an outer face of the metallic tube 1 at a location corresponding to the grooved plug 4. The rolling members 6 are supported by a retaining ring 7. A diameter adjusting die 8 is disposed upstream of the rolling members 6.

Figure 2:
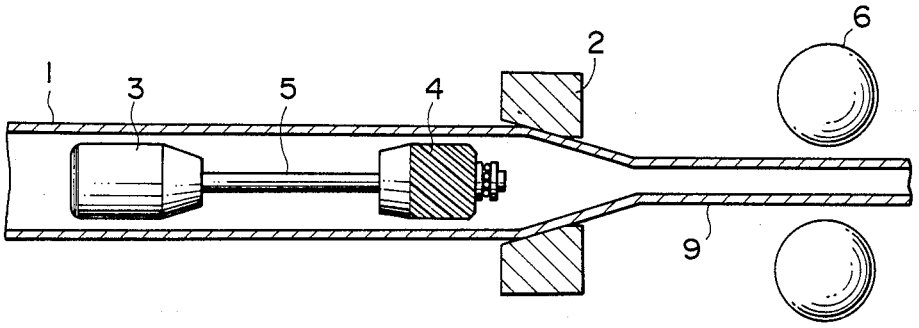
FIG. 2*a* is a schematic sectional view showing a working starting condition according to the process of the present invention.
FIG. 2*b* is a similar view but showing a condition just after starting of the working.
FIG. 2*c* is an enlarged sectional view taken along line A—A of FIG. 1.
FIG. 2*d* is an enlarged view of a portion B of FIG. 1.
FIG. 2*e* is a sectional view taken along line C—C of FIG. 2*d;*
Figure 2:
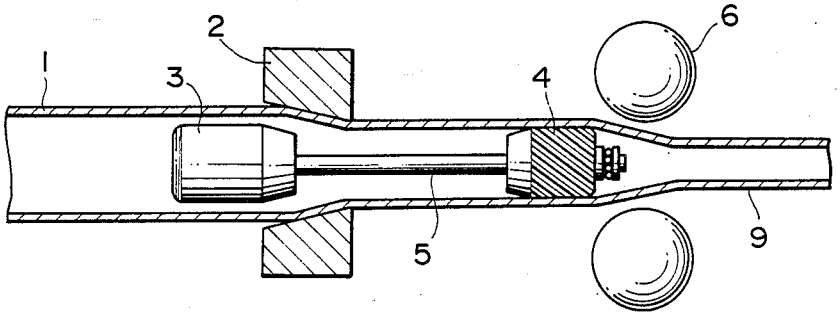
Figure 2:
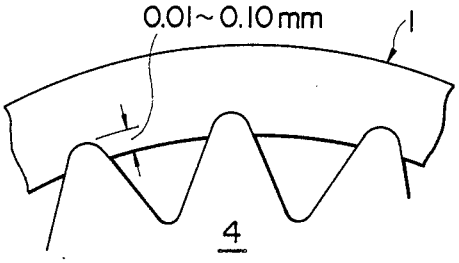
Figure 2:
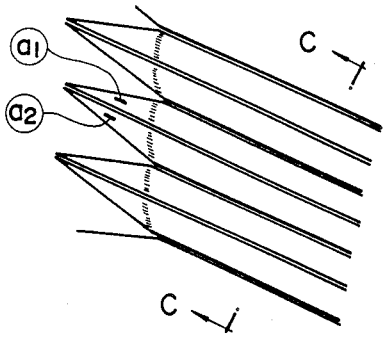
Figure 2:
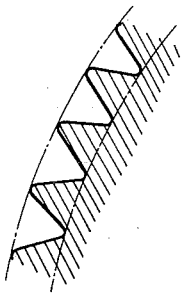
Figure 3:
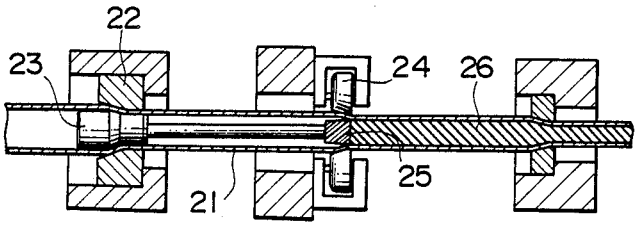
FIGURE 3 PRIOR ART
FIG. 3 is a schematic sectional view showing the working condition of and working equipment for an inner grooved tube according to a conventional tube reducing rolling process.
Figure 4:
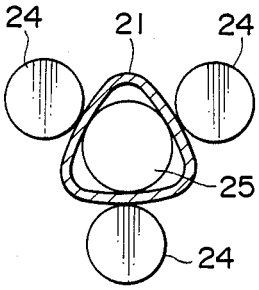
FIGURE 4 PRIOR ART
FIG. 4 is a schematic sectional view illustrating a floating phenomenon which appears in such a conventional tube reducing rolling process.

With the equipment having such construction as described above, when the grooved plug 4 is to be inserted into and supported on the metallic tube, at first a working starting condition such as shown in FIG. 2*a* is assumed. In particular, the floating plug 3 and the grooved plug 4 connected to the floating plug 3 are first inserted into the metallic tube 1 from an end of the metallic tube 1, and then a mouth applying portion 9 is formed on the metallic tube 1 whereafter the metallic tube 1 is passed through and drawn from the tube expanding rolling portion of first die 2 and diameter adjusting die 8.

Figure 6:
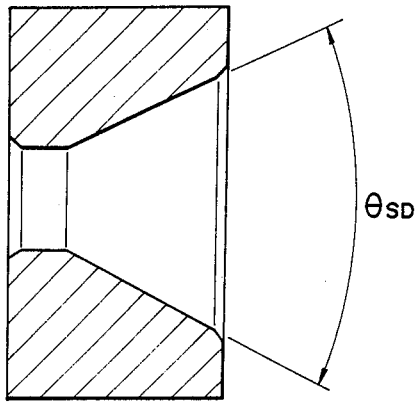
FIGS. 6, 7 and 8 are diagrammatic representations showing full approach angles of a drawing die, a floating plug and a grooved plug, respectively, which are used for practicing the process of the present invention.
Figure 7:
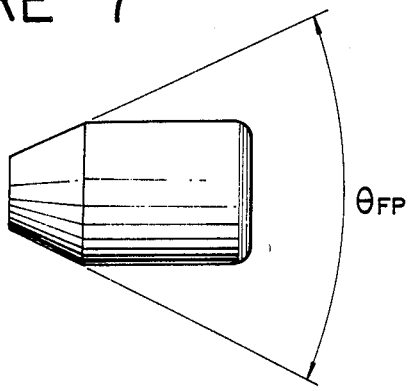

In this instance, the grooved plug 4 passes smoothly through the first die 2 until the condition directly after starting of the working as shown in FIG. 2*b* is reached. To this end, however, the diameter of the exit hole of the first die 2 is designed such that it is greater than the outer diameter of the grooved plug 4 and preferably equal to or a little greater than {(the outer diameter of the grooved plug 4)+(the wall thickness of the metallic tube to be worked)×2}. Further, the floating plug 3 having no bearing portion thereon and the first die are used as means for retaining the grooved plug 4 to a predetermined position, and the full approach angles $\theta_{SD}$ and $\theta_{FP}$ of the drawing die and the floating plug are designed suitably as shown in FIGS. 6 and 7, respectively, such that a condition near an idle drawing condition may be attained wherein little material reducing load may be produced in the drawing step of the metallic tube 1. Preferably, the full approach angles $\theta_{SD}$ and $\theta_{FP}$ are designed such that they comprise angles from 15 to 40 degrees and $\theta_{SD} \geqq \theta_{FP}$ in order to minimize the drawing load to minimize work hardening of the metallic tube to prevent deterioration in workability of the metallic tube.

After starting of the working, the working condition shown in FIG. 1 is reached. In this instance, however, since a plug having no bearing portion thereon is employed as the floating plug 3, the floating plug 3 and the first die 2 cooperate with each other to effect drawing such that the metallic tube is reduced to an outer diameter smaller than the inner diameter of the exit hole of the first die without reducing the wall thickness thereof after the metallic tube passes the exit hole of the first die. The amount of the reduction can be varied by adjusting the angles i.e. (full approach angles $\theta_{SD}$ and $\theta_{FP}$) of the first die 2 and the floating plug 3, and it is preferable that the metallic tube is reduced in diameter such that the inner diameter portion of the metallic tube after passing the exit hole of the first die 2 may contact with an approach portion of the grooved plug with a range of 3% or more of the depth of the grooves from an outer diameter portion of the grooved plug 4. If the inner diameter of the metallic tube after passing the exit of the first die otherwise contacts with a reduction amount smaller than 3% of the depth of the grooves of the grooved plug, then a preliminary shaping effect by the grooved plug 4 cannot be obtained while the amount of distortion in a radial direction of the tube to be worked by rolling with the rolling members 6 at the location of the grooved plug will become greater than the thickness of the preliminarily shaped grooves so that such a floating phenomenon' as may appear in the case of the conventional tube reducing rolling process' may appear between the tube to be worked and the grooved plug 4, which will readily cause an internal defect to appear. Accordingly, a reduction amount smaller than 3% is not preferable.

Figure 8:
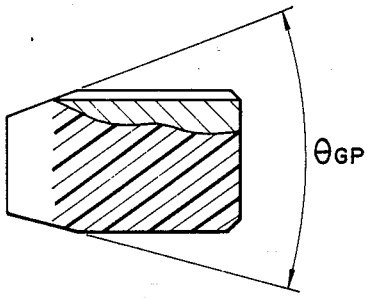

Thus, the workability described above is assured and the grooved plug 4 is retained at a predetermined position in the metallic tube. At the same time, the metallic tube is introduced continuously into the rolling portion while it is being expanded and preliminarily grooved by the grooved plug 4, and then the grooves are shaped while being rolled by the rolling members 6. In this instance, the depth of the preliminarily shaped grooves by the grooved plug 4 is preferably adjusted to be 5 to 50% of the groove depth in order to facilitate indexing of the grooves (refer to FIG. 2*c*). Further, in order to allow the preliminary shaping of the grooves to be performed smoothly with a low resistance to reduce abrasion of the grooved plug 4, it is preferable to provide a suitable full approach angle $\theta_{GP}$ to the entrance side of the grooved plug as shown in FIG. 8 and provide suitable approach faces $a_1$, $a_2$ to end portions of the ridges on the entrance side of the grooved plug as shown in FIG. 2*d*.

It is to be noted that the grooves or ridges of the grooved plug 4 may be of any sectional shape such as a moutain shape, a triangular shape or a trapezoidal shape and of any dimension from shallow grooves to deep grooves or may be one directional spiral grooves or two directional crossing spiral grooves or else straight grooves or otherwise may have any combination of such shapes and dimensions. In short, the grooves of the grooved plug 4 may be of any shape as required for designing in a field of applications thereof. Naturally, in order to form two directional crossing spiral grooves, a pair of grooved plugs may be used to successively form the individual directional spiral grooves.

Finally, the thus grooved metallic tube is passed through the diameter adjusting die 8 to adjust the diameter of the metallic tube so that the inner grooved metallic tube of a predetermined dimension can be produced. The diameter adjusting die may be a suitable die such as a fixed die or a rotary roll.

It is to be noted that the equipment shown in FIG. 1 is an example of equipment for practicing an inner grooving process for metallic tube according to the present invention and it is a matter of course that the equipment can be changed in various manners. For example, the first die or the diameter adjusting die may be any of the fixed type and the rotary type.

Subsequently, an embodiment of the present invention will be described.

Using the equipment having such a construction as shown in FIG. 1, an inner grooved tube having trapezoidal grooves' wherein the outer diameter is 9.52 mm, the depth of the inner grooves is 0.15 mm, the wall thickness of tube is 0.30 mm and having 60 grooves was produced from a stock tube made of annealed phosphorous deoxidized copper and having an outer diameter of 13.0 mm and an inner diameter of 12.26 mm.

At first, lubricant was poured into a metallic tube 1 to be worked from an end of the metallic tube 1, and a floating plug 3 having a full approach angle of 28 degrees and a grooved plug 4 connected for rotation to the floating plug 3 by a tie rod 5 and having an outer diameter of 10.20 mm, a depth of grooves of 0.20 mm and 60 trapezoidal grooves (refer to FIG. 2*e*) were inserted into the metallic tube 1.

Subsequently, an end of the tube was worked to form a mouth applying portion 9, and the mouth applying portion 9 was passed at first through the first die 2 having an exit hole of a fixed diameter (10.96 mmϕ) and having a full approach angle of 28.5 degrees and then through a tube expanding rolling portion and a diameter adjusting die 8 whereafter the mouth applying portion 9 of the tube was clamped by a drawing device not shown, thereby completing the preparing operation for grooving. It is to be noted that the present operation was performed while the rolling members 6 was held in a stopped state without any revolution.

After completion of the preparing operation, the rolling members 6 were revolved, and the drawing device began drawing of the tube 1. At an initial stage of the drawing operation, until the floating plug 3 was brought into a cooperating condition with the first die 2 to reduce the diameter of the tube 1, a completely idle drawing condition continued so that the inner diameter of the tube 1 was reduced only to a dimension smaller by 0.02 mm or so than the outer diameter 10.20 mm of the grooved plug 4. Accordingly, the grooved plug 4 was able to pass readily through the first die 2.

As the drawing step further proceeded, the floating plug 3 and the grooved plug 4 were brought to and thereafter retained at the respective predetermined positions as shown in FIG. 1, and in this condition, the stock tube 1 was reduced in diameter into a tube having an outer diameter of 10.76 mm smaller than the diameter of 10.96 mmϕ of the exit hole of the first die 2 and an inner diameter of 10.00 mm by cooperation of the first die and the floating plug 4. The reduced tube was then expanded smoothly laterally to the tube advancing direction by the grooved plug 4 having an approach portion thereon, and then the tube was bit by a depth of 0.01 to 0.10 mm or so into the grooved plug 4 to preliminarily shape the tube to effect indexing of grooves as shown in FIG. 2*c*.

The tube 1 the grooves of which were preliminarily shaped in this manner was then rolled by the rolling members 6 supported on a revolving path by means of the retaining ring so that the complete grooves of a desired shape were shaped on the inner wall of the tube.

Afterward, the tube 1 was adjusted in terms of its diameter by the diameter adjusting die 8, thereby obtaining an inner grooved tube having a predetermined outer diameter of 9.52 mm.

Figure 5:
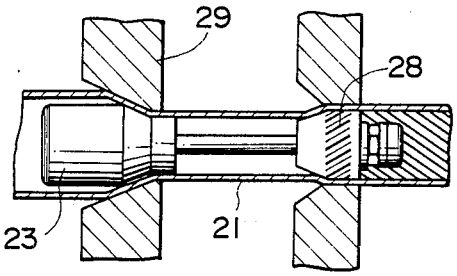
FIGURE 5 PRIOR ART
FIG. 5 is a schematic sectional view showing the working condition of and working equipment for an inner grooved tube according to a conventional tube expanding rolling process.

It was confirmed that the tube produced by the process described above was an inner grooved tube of a high quality which had no internal defect arising from incomplete indexing or various interferences and had a smooth surface compared with an inner grooved tube of a similar type which was produced by the conventional tube reducing grooving process illustrated in FIG. 5.

Figure 9:
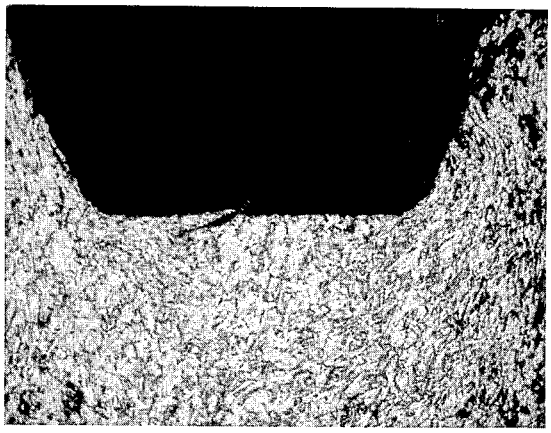
FIG. 9 PRIOR ART
FIG. 9 is a photograph (X200) in section of an inner grooved tube produced by the conventional tube reducing rolling process.
Figure 10:
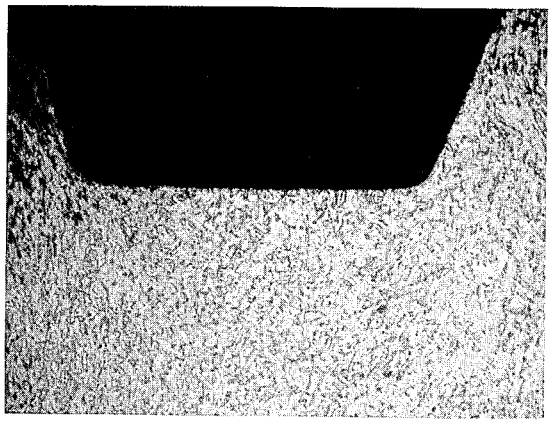
FIG. 10 is a photograph (X200) in section of an inner grooved tube produced by the process of the present invention.

FIG. 9 is a sectional photograph (X200) of the inner grooved tube produced by the conventional tube reducing rolling process, and such defects as cracks can be observed at a groove bottom portion and an inclined face of a ridge portion. Meanwhile, FIG. 10 is a sectional photograph (X200) of the inner grooved tube produced by the process of the present invention, and it can be observed that there are no such defects as cracks either on a groove bottom portion nor on an inclined face of a ridge portion.

Having now fully described the invention, it will be apparent to one of ordinary skill in the art that many changes and modifications can be made thereto without departing from the spirit and scope of the invention as set forth herein.

What is claimed is:

1. An inner grooving process for a metallic tube wherein a metallic tube is reduced in diameter by means of a drawing die and a floating plug and is then grooved on an inner wall thereof by means of a rolling member supported on a retaining ring and a grooved plug whereafter the diameter of the metallic tube is adjusted by means of a diameter adjusting die, and wherein said drawing die has an exit hole of a fixed diameter while said floating plug comprises a plug having no bearing portion thereon, which comprises:

connecting said floating plug and said grooved plug for rotation, said grooved plug having an outer diameter smaller than the diameter of said exit hole of said drawing die;

inserting said floating plug and said grooved plug into said metallic tube upstream of said drawing die;

drawing said grooved plug while within said metallic tube through said drawing die to a predetermined location of said rolling member and retaining said grooved plug at said predetermined location, whereafter said floating plug and said drawing die cooperate with each other for reducing the inner diameter of the metallic tube to a dimension smaller than the outer diameter of the grooved plug; and tube expanding rolling drawing the metallic tube with said rolling member and said grooved plug for expanding and grooving the metallic tube continuously.

2. A process according to claim 1, wherein said drawing die and said floating plug have full approach angles $\theta_{SD}$ and $\theta_{FP}$ of 15 to 40 degrees and $\theta_{SD} \geqq \theta_{FP}$, and which comprises drawing said grooved plug into while within the metallic tube to said predetermined location by drawing of the metallic tube in a substantially idle drawing condition.

3. A process according to claims 1 or 2, wherein the diameter reducing working with said drawing die and said floating plug comprises reducing the diameter of the metallic tube such that an inner diameter portion of the metallic tube after passing said exit of said drawing die contacts with an approach portion of said grooved plug over a range greater than 3% of the depth of the grooves of said grooved plug from an outer diameter portion of said grooved plug.

* * * * *